US006431509B1

(12) United States Patent
Proulx

(10) Patent No.: US 6,431,509 B1
(45) Date of Patent: Aug. 13, 2002

(54) PAINT CAN HOLDER

(76) Inventor: Pierre Proulx, 168, 5e rang ouest, Stoke (Québec) (CA), J0B 3G0

( * ) Notice: Subject to any disclaimer, the term of this patent is extended or adjusted under 35 U.S.C. 154(b) by 0 days.

(21) Appl. No.: 09/689,866

(22) Filed: Oct. 13, 2000

(51) Int. Cl.[7] ..... E06C 7/14

(52) U.S. Cl. ..... 248/210; 248/211; 248/215; 182/121; 182/129

(58) Field of Search ..... 248/210, 211, 248/215, 340, 304; 182/121, 129, 122

(56) References Cited

U.S. PATENT DOCUMENTS

| | | | | | |
|---|---|---|---|---|---|
| 2,236,187 | A | * | 3/1941 | Penney | 248/210 |
| 2,496,057 | A | * | 1/1950 | Lombard et al. | 248/238 |
| 3,001,751 | A | * | 9/1961 | Bozik | 248/210 |
| 3,108,776 | A | | 10/1963 | Cook | |
| 3,312,441 | A | * | 4/1967 | Molenda | 248/210 |
| 3,448,956 | A | * | 6/1969 | Kuhaneck, Jr. | 248/210 |
| 3,738,601 | A | * | 6/1973 | Gehringer | 248/210 |
| 3,814,364 | A | | 6/1974 | Gargaro | |
| 4,013,251 | A | | 3/1977 | Cleveland | |
| 4,433,822 | A | * | 2/1984 | Caggiano | 248/210 |
| 5,062,607 | A | | 11/1991 | Kisner | |
| 5,079,795 | A | * | 1/1992 | Schmid | 248/210 |
| 5,133,525 | A | | 7/1992 | Good | |

FOREIGN PATENT DOCUMENTS

| | | | |
|---|---|---|---|
| GB | 2254361 | * | 7/1992 |

* cited by examiner

*Primary Examiner*—Kimberly T. Wood

(57) ABSTRACT

The paint can holder is adapted for mounting on the rungs of a ladder and holding a paint can thereon while allowing the painter to attend to his work with both his hands free. The holder comprises a vertically mountable elongated member which has a curved part at the top, which is shaped to engage an upper rung of a ladder. The elongated member also has an attachment at its bottom end, which is constructed to snappingly engage a lower rung. The elongated member comprises a support which is provided between the curved part and the attachment. The holder comprises a brace which is arranged to hold the paint can and to be fixed along the elongated member. A paint brush handle holder may be provided along the curved part of the elongated member.

5 Claims, 2 Drawing Sheets

PAINT CAN HOLDER

BACKGROUND OF INVENTION (a) Field of the Invention

This invention relates to a paint can holder. More particularly, the invention relates to a device for mounting a paint can on rungs of a ladder, while allowing the painter to use both hands when attending to his work.

(b) Description of Prior Art

A number of paint can holders are known especially when used in a adder. Examples of such paint can holders are disclosed in the following U.S. Pat. Nos.:

3,108,776

3,814,364

4,013,251

5,062,607

5,133,525

U.S. Pat. No. 3,108,776 describes a holder for paint cans consisting of an L-shaped strap having curved lower and upper portions adapted to engage the stiles of a ladder. The clamping system used to hold the paint can against the L-shaped strap includes one leg which is placed inside the can and is attached to the L-shaped strap by means of a bolting system. No provision is made for holding the paint brush. This system is more complicated than is necessary and is obviously too costly to produce to make it an attractive device.

U.S. Pat. No. 3,814,364 is mainly characterized by providing a support for the paint can and a lanced portion for holding the can in place through its bail. It is not believed that holding the paint can through its bail is practical.

U.S. Pat. No. 4,013,251 describes another paint can holder which is characterized by having a lower brace arm which is pivotally engaged with the platform. Except for the platform, the device has no other part enabling the can to be fixedly secured to the can holder.

U.S. Pat. No. 5,062,607 relates to a holder for detachably mounting a receptacle on a ladder. The restrain member has to be fixed on the L-member by means of a wing nut which is a clear disadvantage.

The support device of U.S. Pat. No. 5,133,525 is somewhat similar to the one described in U.S. Pat. No. 5,062,607 and has the same disadvantages.

SUMMARY OF INVENTION

It is an object of the present invention to provide a paint can support which is inexpensive and easy to produce and which overcomes most of the disadvantages of the prior art.

It is another object of the present invention to provide a can holder wherein the individual parts are unitary and which are fast to mount and assemble.

These and other objects of the invention may be achieved by providing a paint can holder for mounting on rungs of a ladder and holding a paint can thereon. The paint can holder comprises a vertically mountable elongated member comprising

- a curved part at a top end of the elongated member, the curved part shaped to engage an upper rung of the ladder,
- an attachment at a lower end of the elongated member, constructed to fixedly and removably mount the lower end on a lower rung of the ladder,
- a support provided on the elongated member between the curved part and the attachment to rest the paint can thereon, and

- a brace arranged to hold the paint can and to be fixed along the elongated member.

According to a preferred embodiment, the elongated member comprises an upper straight portion and a lower inwardly curving portion, the support being provided substantially at a junction between the upper portion and the lower portion.

According to yet another embodiment, the holder comprises a right angle member disposed over the curved part and is shaped to retain a paint brush handle therein.

According to still yet another embodiment, the support consists of a triangular member, an upper face thereof projecting at right angle from a front face of the elongated member.

According to another embodiment, the paint holder according to the invention may comprise a recess provided at a junction between the upper face of the triangular member and the elongated member, the recess being shaped to engage a lower circumferential rim of the paint can.

Preferably, the attachment comprises an upper downwardly curving strip having a catch at an outer end thereof, and a lower straight strip having an inwardly turned hook at an outer end thereof, the hook being capable of snappingly holding the catch when both the upper and lower strips are engaged over the lower rung.

According to yet another embodiment, a rectangular recess is provided on an outer face of the elongated member in the upper portion thereof above the support, the brace comprises a circular band shaped to fit around an outer surface of a paint can, and a wrap around strip having an engaging lip at an outer end thereof, so constructed and arranged that after placing the brace around a paint can, the paint can is placed on the support with the brace received in the rectangular recess and the wrap around strip is placed against an inner face of the elongated member with the engaging lip snappingly engaging the elongated member.

BRIEF DESCRIPTION OF DRAWINGS

The invention will be more readily understood from a detailed description of one embodiment given below with reference to the accompanying drawings which are given by way of illustration only, and are therefore not limitative of present invention, and in which.

DESCRIPTION OF PREFERRED EMBODIMENTS

Figure 1:
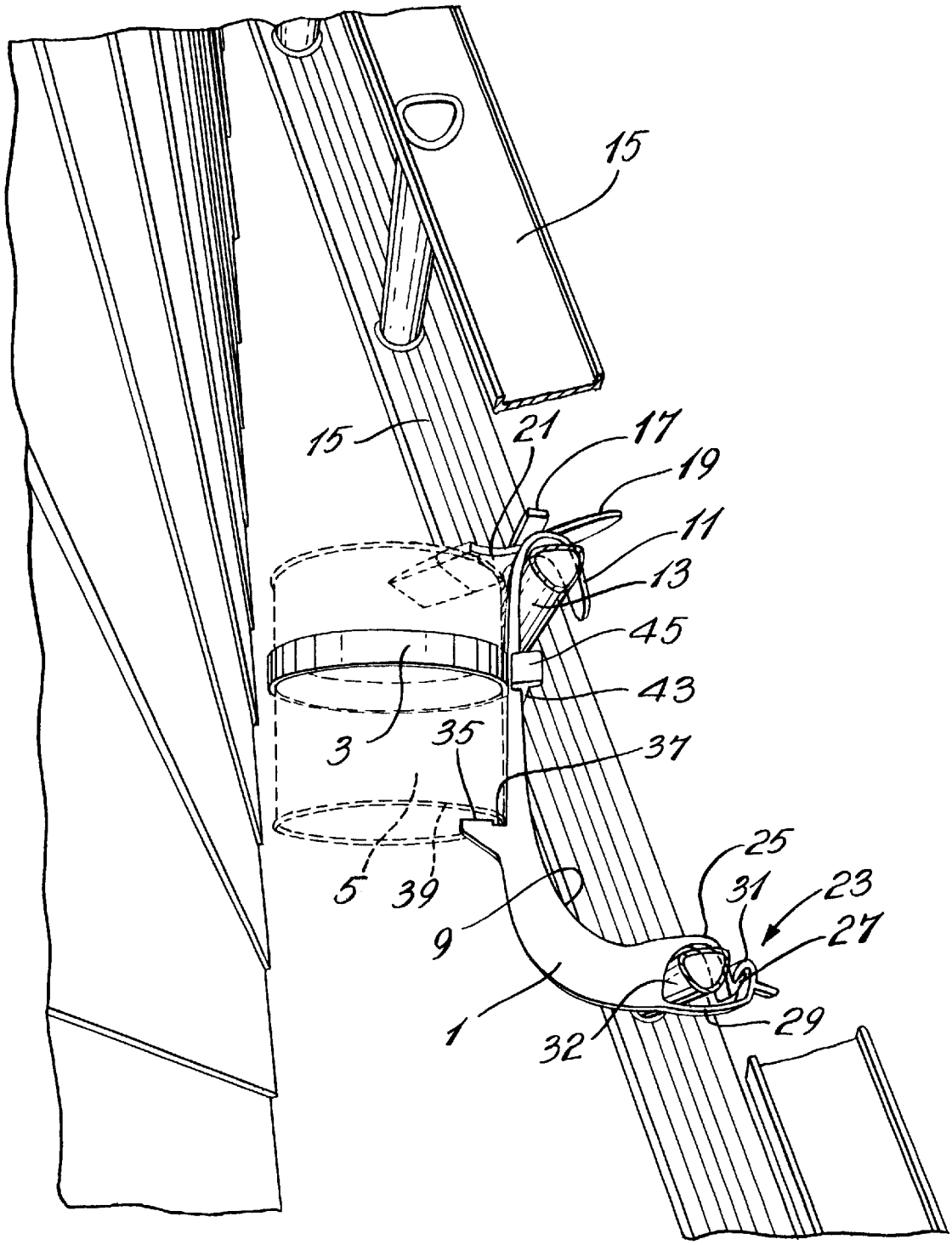
FIG. 1 is a perspective view of a paint can support according to the invention as mounted on a ladder.
Figures 2, 3:
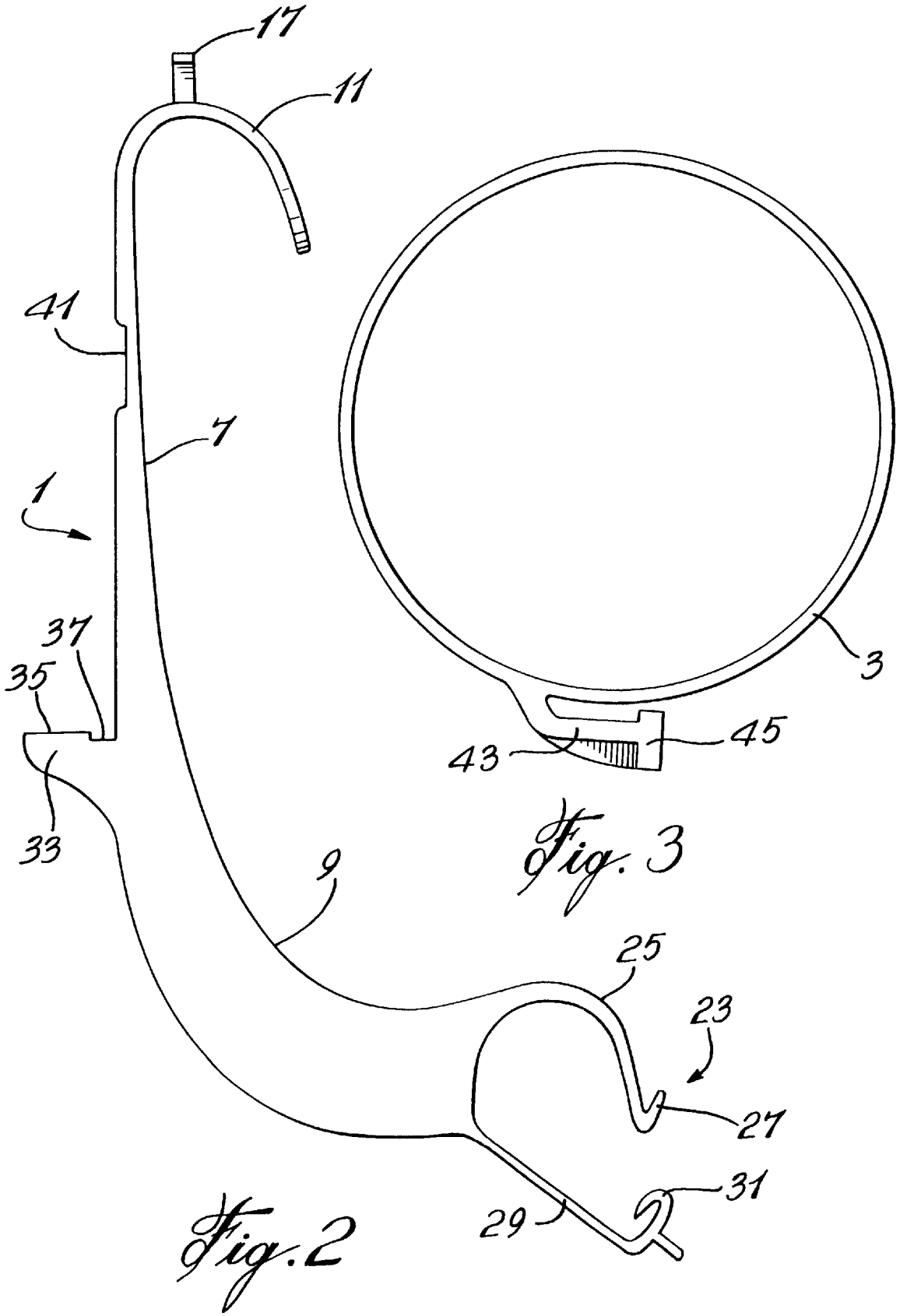
FIG. 2 is a side view of the main part of the paint can holder.
FIG. 3 is a side view of the paint can brace.

With reference to the drawings, it will be seen that the paint can holder which has been illustrated without limitation, essentially comprises a vertically mountable elongated member 1 which is generally L-shaped, and a circumferential brace 3 which is constructed to hold paint can 5 in place once it is fixed to elongated member 1 as will be described in detail later.

More particularly, elongated member 1 is of unitary construction and is preferably produced by molding from a suitable plastic material, as will be appreciated by one skilled in the art. Although it has a uniform width, its thickness, as viewed from the side gradually increases from top to bottom, so as to give it sufficient strength when in use. Elongated holder 1, comprises an upper straight portion 7 and a lower inwardly curving portion 9.

At the top end of upper straight portion 7 there is an inwardly curved part 11 which is shaped to engage an upper rung 13 of a ladder 15. Over curved part 11 and at the top thereof, there is a right angle member 17 which is dimensioned to retain handle 19 of a paint brush 21.

The lower inwardly curving portion 9 is terminated by an attachment 23 which as shown is made of two parts, namely an upper downwardly curving strip 25 which has a catch 27 at its extremity, and a lower straight strip 29 which is formed with an inwardly turned hook 31 at its outer end. It will be seen that hook 31 is capable of snappingly engaging catch 27 when both upper and lower strips 25 and 29 are engaged over a lower rung 32 of ladder 15.

Referring again to the drawings, it will be seen that elongated member 1 is formed on the outward face thereof with a support 33 which is in the general form of a triangular member, which is unitary with elongated member 1. The upper face 35 of support 33 projects, as shown, at right angle from the outward face of elongated member 1, to constitute a base on which paint can 5 can rest. Additionally, a recess 37 appears at the junction between the outward face of elongated member 1 and upper face 35 of the triangular member. The recess is shaped to receive lower circumferential rim 39 of paint can 5. Finally, a rectangular recess 41 is provided on the outward face of elongated member 1 on upper portion 7 thereof above support 33, just short of inwardly curved part 11. As will be explained later, recess 41 is exactly shaped to receive a brace part that will now be described.

Turning now to brace 3, it is shaped as a continuous band that is dimensioned to fit over a standard paint can. In practice, the paint can support according to the invention will be supplied with as many braces 3 as there are paint can sizes on the market, normally a standard large size and a standard small size. Along the outer face of brace 3, there is a short projection in the form of a wrap around strip 43, which has an engaging lip 45 at the outer end thereof. As shown, brace 3 is constructed in such a manner that after placing it around paint can 5, the paint can with the brace mounted around it, is placed on support 33 with its lower circumferential rim 35 received in recess 37 and the continuous band received in rectangular recess 41. Wrap around strip 35 is then placed against the inner face of elongated member 1 with engaging lip 45 snappingly engaging the elongated member as shown in FIG. 1.

Modifications are of course possible provided they fall within the scope of the appended claims.

I claim:

1. A paint can holder for mounting on rungs of a ladder and holding a paint can thereon, said paint can holder comprising a vertically mountable elongated member comprising an upper straight portion and a lower inwardly curving portion, a curved part at a top end of said upper straight portion, said curved part shaped to engage an upper rung of said ladder, an attachment at a lower end of said elongated member, constructed to fixedly and removably mount said lower end on a lower rung of said ladder, a support provided on said elongated member between said curved part and said attachment, substantially at a junction between said upper portion and said lower portion, to rest said paint can thereon, said support consisting of a triangular member, an upper face thereof projecting at night angle from a front face of said elongated member, and a brace arranged to hold said paint can and to be fixed along said elongated member.

2. A paint can holder according to claim 1, which comprises a right angle member disposed over said curved part and shaped to retain a paint brush handle therein.

3. A paint can holder according to claim 1, which comprises a recess provided at a junction between said upper face of said triangular member and said elongated member, said recess shaped to engage a lower circumferential rim of said paint can.

4. A paint can holder according to claim 1, wherein said attachment comprises an upper downwardly curving strip having a catch at an outer end thereof, and a lower straight strip having an inwardly turned hook at an outer end thereof, said hook capable of snappingly holding said catch when both said upper and lower strips are engaged over said lower rung.

5. A paint can holder according to claim 1, wherein a rectangular recess is provided on an outer face of said elongated member in the upper portion thereof above said support, said brace comprises a circular band shaped to fit around an outer surface of a paint can, and a wrap around strip having an engaging lip at an outer end thereof, so constructed and arranged that after placing said brace around a paint can said paint can is placed on said support with said brace received in said rectangular recess and said wrap around strip is placed against an inner face of said elongated member with said engaging lip snappingly engaging said elongated member.

* * * * *